US009970269B2

(12) United States Patent
Lopez et al.

(10) Patent No.: US 9,970,269 B2
(45) Date of Patent: May 15, 2018

(54) EXPANDABLE WELL SCREEN HAVING ENHANCED DRAINAGE CHARACTERISTICS WHEN EXPANDED

(71) Applicant: HALLIBURTON ENERGY SERVICES, INC., Houston, TX (US)

(72) Inventors: Jean-Marc Lopez, Plano, TX (US); Luke W. Holderman, Plano, TX (US); Stephen M. Greci, Little Elm, TX (US); Gregory S. Cunningham, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 799 days.

(21) Appl. No.: 14/312,477

(22) Filed: Jun. 23, 2014

(65) Prior Publication Data

US 2015/0000897 A1 Jan. 1, 2015

(51) Int. Cl.
*E21B 43/08* (2006.01)
*E21B 43/10* (2006.01)

(52) U.S. Cl.
CPC ..... *E21B 43/086* (2013.01); *E21B 43/082* (2013.01); *E21B 43/084* (2013.01); *E21B 43/088* (2013.01); *E21B 43/108* (2013.01)

(58) Field of Classification Search
CPC .... E21B 43/086; E21B 43/084; E21B 43/088; E21B 43/082; E21B 43/108
See application file for complete search history.

(56) References Cited

U.S. PATENT DOCUMENTS 1,520,376 A * 12/1924 Verneuil ..... E21B 43/084 166/230
2,371,391 A * 3/1945 Haynes ..... E21B 43/086 166/171
2,812,025 A * 11/1957 Doherty ..... E21B 43/086 166/191
3,025,914 A * 3/1962 Fether ..... E21B 43/086 166/235
6,382,318 B1 * 5/2002 Whitlock ..... B01D 29/15 166/233

(Continued)

OTHER PUBLICATIONS

Dictionary definition of "mesh", accessed Jul. 27, 2017 via thefreedictionary.com.*

(Continued)

*Primary Examiner* — Blake E Michener
(74) *Attorney, Agent, or Firm* — Locke Lord LLP; Christopher J. Capelli; Joshua L. Jones

(57) ABSTRACT

An expandable well screen can include a filter section which is displaced outward when the well screen is positioned downhole, the filter section including an outer surface that is recessed relative to a raised boundary of the filter section adjacent the recessed outer surface. Another filter section can include an outer surface having one more structures thereon which space the outer surface away from a well surface when the filter section is displaced outward. Another filter section can include one or more structures on an interior thereof which space apart inner and outer sides of a wall of the filter section, a telescoping tubular connector which provides fluid communication between the filter section and a base pipe of the well screen, and a filter media being positioned in the tubular connector.

24 Claims, 11 Drawing Sheets

(56) References Cited

U.S. PATENT DOCUMENTS 6,571,871 B2 * 6/2003 Lauritzen ..... E21B 43/08 166/207
7,121,352 B2 * 10/2006 Cook ..... E21B 33/10 166/117.6
7,216,706 B2 * 5/2007 Echols ..... E21B 33/12 166/177.1
7,757,758 B2 * 7/2010 O'Malley ..... E21B 17/1078 166/206
8,256,510 B2 * 9/2012 Holderman ..... E21B 43/08 166/227
8,291,972 B2 * 10/2012 Dusterhoft ..... E21B 43/08 166/227
8,302,680 B2 * 11/2012 Holderman ..... E21B 17/026 166/227
8,550,157 B2 * 10/2013 O'Malley ..... E21B 43/08 166/227
8,701,757 B2 4/2014 Greci
8,881,804 B2 * 11/2014 Kang ..... E21B 43/103 166/100
2002/0129935 A1 * 9/2002 Castano-Mears ..... E21B 43/084 166/227
2003/0021922 A1 * 1/2003 Bode ..... B01D 39/12 428/34.4
2003/0075323 A1 * 4/2003 Vercaemer ..... E21B 43/103 166/277
2004/0055758 A1 * 3/2004 Brezinski ..... E21B 33/12 166/384
2004/0060695 A1 * 4/2004 Castano-Mears ..... E21B 43/084 166/228
2004/0123983 A1 * 7/2004 Cook ..... E21B 33/10 166/50
2005/0139359 A1 * 6/2005 Maurer ..... E21B 43/08 166/380
2005/0150654 A1 * 7/2005 Kirk ..... E21B 43/103 166/206
2005/0173130 A1 * 8/2005 Richard ..... E21B 43/086 166/384
2006/0090903 A1 * 5/2006 Gano ..... E21B 33/12 166/384
2008/0041577 A1 * 2/2008 Baaijens ..... E21B 43/08 166/74
2008/0217002 A1 * 9/2008 Simonds ..... E21B 43/084 166/230
2008/0289815 A1 * 11/2008 Moen ..... E21B 43/086 166/230
2009/0078403 A1 * 3/2009 Langlais ..... E21B 43/084 166/56
2009/0173497 A1 7/2009 Dusterhoft
2010/0051270 A1 3/2010 Dusterhoft et al.
2010/0163481 A1 * 7/2010 McGrenera ..... E21B 43/084 210/489
2010/0258301 A1 * 10/2010 Bonner ..... E21B 43/084 166/230
2010/0258302 A1 * 10/2010 Bonner ..... E21B 43/084 166/244.1
2011/0036565 A1 2/2011 Holderman et al.
2011/0036567 A1 * 2/2011 Holderman ..... E21B 17/026 166/228
2011/0042096 A1 * 2/2011 Nutley ..... E21B 43/08 166/369
2011/0180257 A1 7/2011 Scott et al.
2012/0298352 A1 * 11/2012 Holderman ..... E21B 43/103 166/227
2013/0036591 A1 2/2013 Holderman et al.
2013/0092394 A1 * 4/2013 Holderman ..... E21B 43/108 166/373
2013/0105145 A1 * 5/2013 Gupta ..... E21B 43/084 166/230
2014/0076540 A1 * 3/2014 Kang ..... E21B 43/103 166/277

OTHER PUBLICATIONS

International Search Report and Written Opinion issued Mar. 25, 2014 for PCT Patent Application No. PCT/US13/048733, 12 pages.
Halliburton, "PetroGuard® Swell Screen", product specification, H07653, dated Jan. 2012, 2 pages.
Halliburton, "Sand Control Screen and Inflow Control Technology Solutions", product brochure, H08391, dated Apr. 2012, 2 pages.
Examination Report dated Mar. 21, 2016 Australian Patent Office Application No. 2013396210.

* cited by examiner

EXPANDABLE WELL SCREEN HAVING ENHANCED DRAINAGE CHARACTERISTICS WHEN EXPANDED

CROSS-REFERENCE TO RELATED APPLICATION

This application claims the benefit under 35 USC § 119 of the filing date of International Application Serial No. PCT/US13/48733, filed 28 Jun. 2013. The entire disclosure of this prior application is incorporated herein by this reference.

BACKGROUND

This disclosure relates generally to equipment utilized and operations performed in conjunction with a subterranean well and, in one example described below, more particularly provides an expandable well screen with enhanced drainage when the screen is expanded downhole.

An expandable well screen can be used, for example, to support a wellbore wall and/or consolidate a gravel pack external to the well screen in production or injection operations. In one type of expandable well screen, a swellable material is used to displace filter sections of the well screen radially outward.

However, the swellable material can extrude onto an outer surface of a filter section, thereby reducing a surface area of the filter section available for fluid flow. In cased hole applications, the filter section may be pressed against a perforated casing or liner, so that only a surface area of the filter section exposed to perforations is available for fluid flow. Other problems may be experienced with expandable well screens, as well.

Therefore, it will be appreciated that improvements are continually needed in the arts of constructing and utilizing expandable well screens.

DETAILED DESCRIPTION

Figure 1:
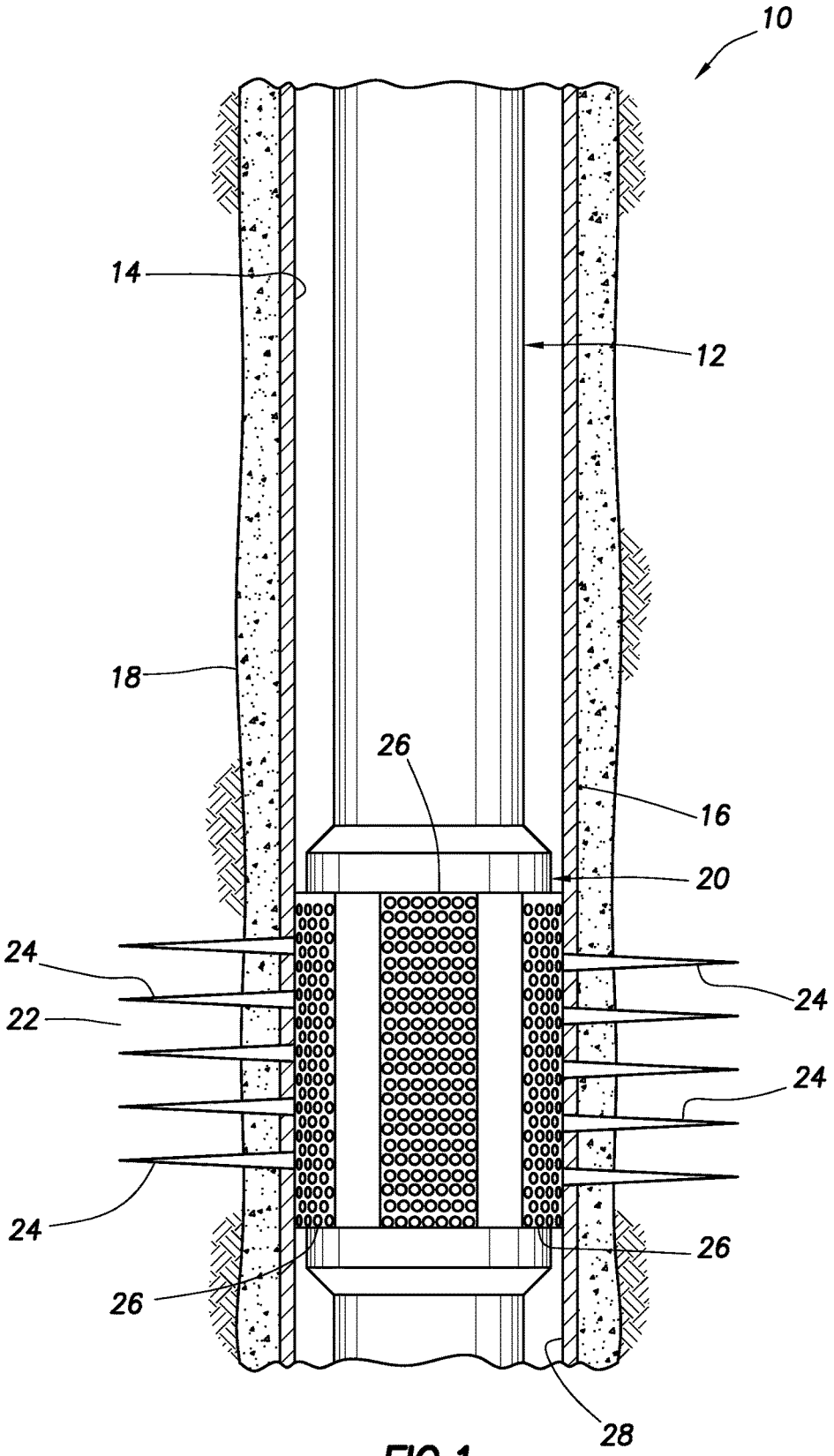
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 (such as, a production tubing string, an injection string, etc.) is positioned in a wellbore 14 lined with casing (or liner) 16 and cement 18. The tubular string includes an expandable well screen 20 for filtering fluid which flows between an interior of the tubular string 12 and an earth formation 22 penetrated by the wellbore 14.

In this example, the casing 16 and cement 18 are perforated to permit such flow between the formation 22 and the interior of the tubular string 12. The well screen 20 may be positioned directly adjacent or opposite perforations 24 which extend through the casing 16 and cement 18, and into the formation 22.

When the well screen 20 is expanded radially outward downhole, filter sections 26 thereof are displaced radially outward, until they contact an interior surface 28 of the casing 16. One manner in which the filter sections 26 can be displaced outward is described more fully below.

In the FIG. 1 example, the surface 28 comprises an inner surface of the casing 16, which also defines the wellbore 14 at this location. In other examples, the wellbore 14 could be uncased or open hole at the location where the well screen 20 is expanded, in which case the surface 28 could be a wall of the formation 22 exposed to the wellbore.

In some examples, gravel or another substance could be interposed between the well screen 20 and the well surface 28, in which case the filter sections 26 may not contact the well surface when they are displaced outward. The gravel or other substance could be interposed between the well screen 20 and the well surface 28 before or after the filter sections 26 are displaced outward.

Thus, it should be clearly understood that there are many variations possible for the system 10 and its associated method. Accordingly, the scope of this disclosure is not limited to any of the details of the system 10 and method, or of the well screen 20 and its operation, as depicted in the drawings or described herein.

It will be appreciated by those skilled in the art that, in the FIG. 1 example, the contact between the filter sections 26 and the surface 28 at the location of the perforations 24 substantially reduces an area available for flow between the perforations and an interior of the filter sections. That is, the flow will be substantially restricted to the area of the perforations 24 overlying the filter sections 26.

This is an undesirable situation, because, for a given pressure differential, a smaller flow area typically results in increased flow velocity. Such increased flow velocity can lead to relatively rapid erosion of the filter sections 26 where the perforations 24 overlie the filter sections. If the filter sections 26 are eroded through, their filtering capacity can be severely diminished or eliminated.

Figure 2:
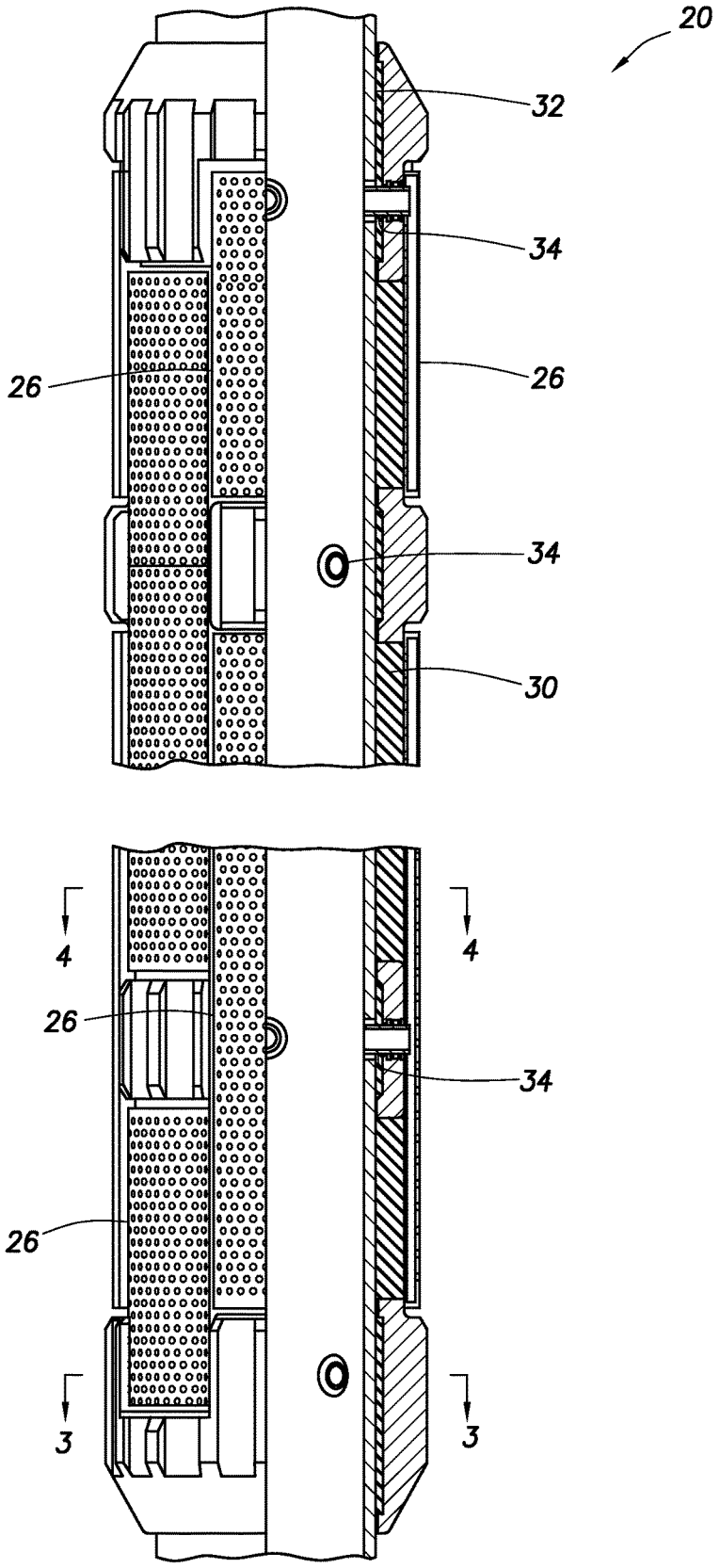
FIG. 2 is a representative side view of an expandable well screen which can embody the principles of this disclosure, and which may be used in the system and method of FIG. 1.

Referring additionally now to FIG. 2, a side view of one example of the well screen 20 is representatively illustrated. The well screen 20 in this example includes multiple circumferentially distributed and longitudinally elongated filter sections 26 that are displaced outward by swelling of an underlying swellable material 30 after the well screen is positioned downhole.

Preferably, the swellable material 30 swells when it is contacted with a particular activating agent (e.g., oil, gas, other hydrocarbons, water, acid, other chemicals, etc.) in the well. The activating agent may already be present in the well, or it may be introduced after installation of the well screen 20 in the well, or it may be carried into the well with the screen, etc. The swellable material 30 could instead swell in response to exposure to a particular temperature, or upon passage of a period of time, or in response to another stimulus, etc.

Thus, it will be appreciated that a wide variety of different ways of swelling the swellable material 30 exist and are known to those skilled in the art. Accordingly, the scope of this disclosure is not limited to any particular manner of swelling the swellable material 30. Furthermore, the scope of this disclosure is also not limited to any of the details of the well system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 30 is in this example preferably a hydrocarbon fluid (such as oil or gas). In the well system 10, the swellable material 30 swells when a fluid in the well comprises the activating agent (e.g., when the fluid enters the wellbore 14 from the formation 22 surrounding the wellbore, when the fluid is circulated to the well screen 20 from the surface, when the fluid is released from a chamber carried with the well screen, etc.). In response, the swellable material 30 swells and displaces the filter sections 26 radially outward.

The activating agent which causes swelling of the swellable material 30 could be comprised in any type of fluid. The activating agent could be naturally present in the well, or it could be conveyed with the well screen 20, conveyed separately or flowed into contact with the swellable material 30 in the well when desired. Any manner of contacting the activating agent with the swellable material 30 may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material 30 may have a substantial portion of cavities therein which are compressed or collapsed at the surface condition. Then, after being placed in the well at a higher pressure, the material 30 is expanded by the cavities filling with fluid.

This type of apparatus and method might be used where it is desired to expand the swellable material 30 in the presence of gas rather than oil or water. A suitable swellable material is described in U.S. Published Application No. 2007-0257405, the entire disclosure of which is incorporated herein by this reference.

Preferably, the swellable material 30 used in the well screen 20 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material 30 could also swell in response to contact with any of multiple activating agents. For example, the swellable material 30 could swell when contacted by hydrocarbon fluid, or when contacted by water.

The filter sections 26 and swellable material 30 are positioned exteriorly on a base pipe 32 of the well screen 20. The base pipe 32 is preferably configured for connection in the tubular string 12 (e.g., with appropriate threaded connections at either end, etc.). Generally tubular connectors 34 provide fluid communication between interiors of the filter sections 26 and an interior of the base pipe 32.

Figure 3:
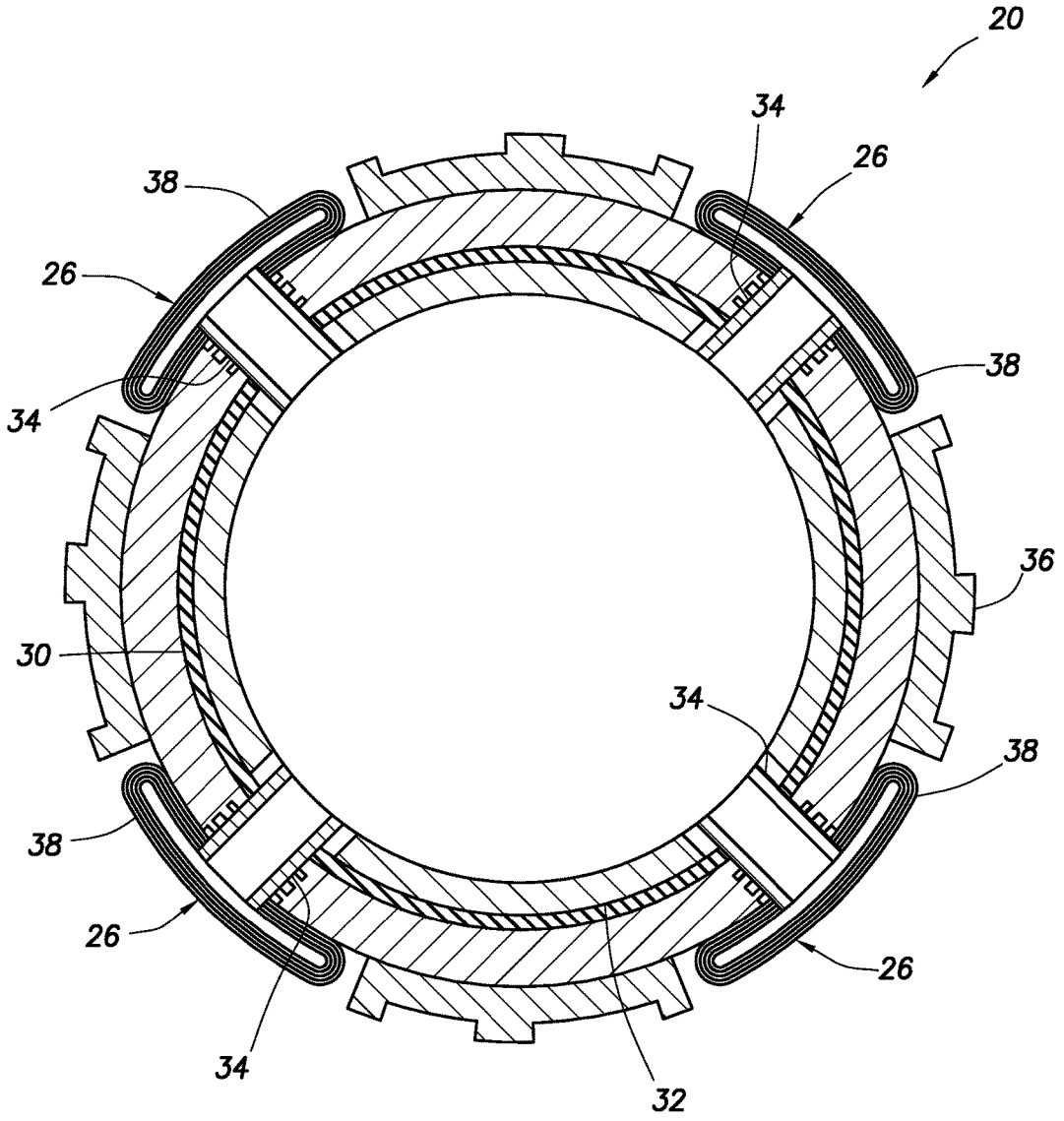
FIGS. 3 & 4 are representative cross-sectional views of the well screen, taken along respective lines 3-3 and 4-4 of FIG. 2.

The manner in which the connectors 34 provide for fluid communication between the filter sections 26 and the base pipe 32 can be readily seen in FIG. 3. Note that the connectors 34 are sealingly and telescopingly received in structures 36 configured for this purpose and sealed to the base pipe 32 by the swellable material 30.

Figure 4:
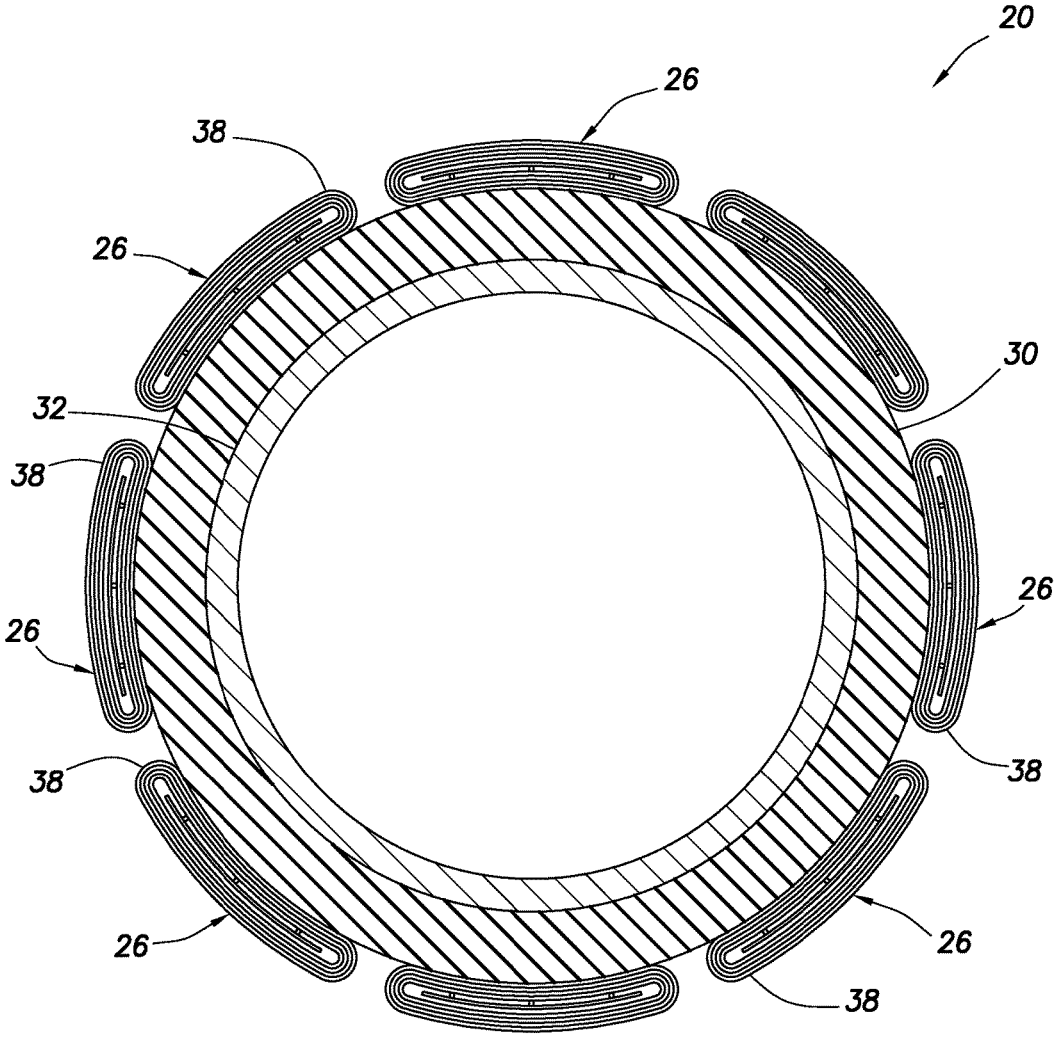

The manner in which the swellable material 30 underlies the filter sections 26, so that, when the swellable material swells, the filter sections are displaced radially outward can be readily seen in FIG. 4. Note that other ways of expanding a well screen may be used, without departing from the scope of this disclosure. For example, a well screen could be expanded by pressurizing the well screen internally, a well screen could be expanded by driving an expansion wedge longitudinally through the well screen, etc.

In the FIGS. 1-4 example, the filter sections 26 are somewhat circular-shaped in cross-section, that is, extending partially circumferentially relative to an outer surface of the well screen 20. Each filter section 26 comprises a circumferentially extending wall 38 that is formed, in this example, from a circular, tubular shape by dies that "smash" the wall, so that it has inner and outer sides, with a space therebetween. The space between the inner and outer sides of the wall 38 defines the interior of the filter section 26, which is in fluid communication with the interior of the base pipe 32 via the connector 34.

Preferably, the wall 38 comprises a filter media, and can include multiple layers of materials. For example, the wall 38 could be made up of layers including an outer protective shroud, a relatively coarse square wire weave as a drainage layer, a relatively file wire mesh as a filter layer, an inner protective shroud, etc. Any number, type and/or combination of layers may be used in the filter section wall 38 in keeping with the scope of this disclosure.

Figure 5:
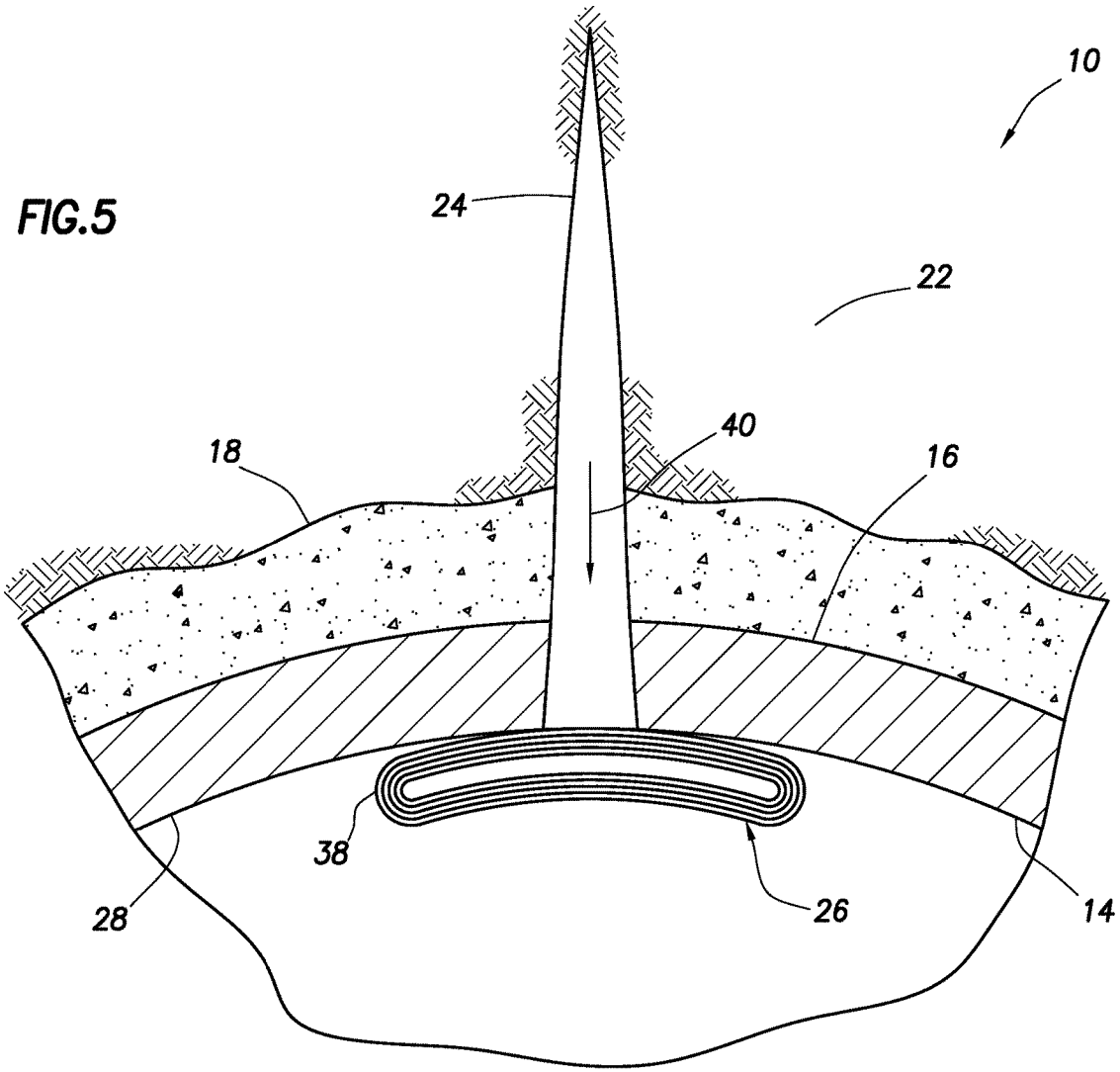
FIG. 5 is a representative cross-sectional view of a filter section of the well screen displaced against a well surface.

Referring additionally now to FIG. 5, a cross-sectional view of one of the filter sections 26 in the system 10, apart from the remainder of the well screen 20, is representatively illustrated. In this view, the filter section 26 is displaced into contact with the well surface 28 (e.g., due to swelling of the swellable material 30).

It will be appreciated that, although the entire outer side of the filter section wall 38 may be capable of filtering fluid 40 which flows between the formation 22 and the interior of the filter section 26 (i.e., the space between the inner and outer sides of the wall), the flow of the fluid will instead be concentrated so that it flows predominantly through a relatively small area where the perforation 24 overlies the outer side of the wall 38. This can lead to relatively rapid erosion of this area of the wall 38, as mentioned above.

In addition, it is possible for the swellable material 30 to extrude around the filter section 26, so that it at least partially covers the outer side of the filter section. This reduces the area available for flow of the fluid 40, and can occur whether the wellbore 14 is cased or uncased. Note that, although the fluid 40 is depicted as flowing from the formation 22 into the filter section 26, in other examples (e.g., in injection operations), the fluid could flow from the filter section to the formation.

It will be appreciated that it would be desirable to prevent a reduction of area for flow of the fluid 40, whether the reduction is due to contact between the filter section 26 and the well surface 28, due to extrusion of the swellable material 30 around the filter section, or due to other causes. Examples of filter sections 26 described below can be used with the well screen 20 to substantially increase the area for flow of the fluid 40, whether or not a perforation 24 overlies the filter section, the filter section is in contact with the casing 16 or other well surface 28, or the filter section is displaced outward by the swellable material 30.

Figure 6:
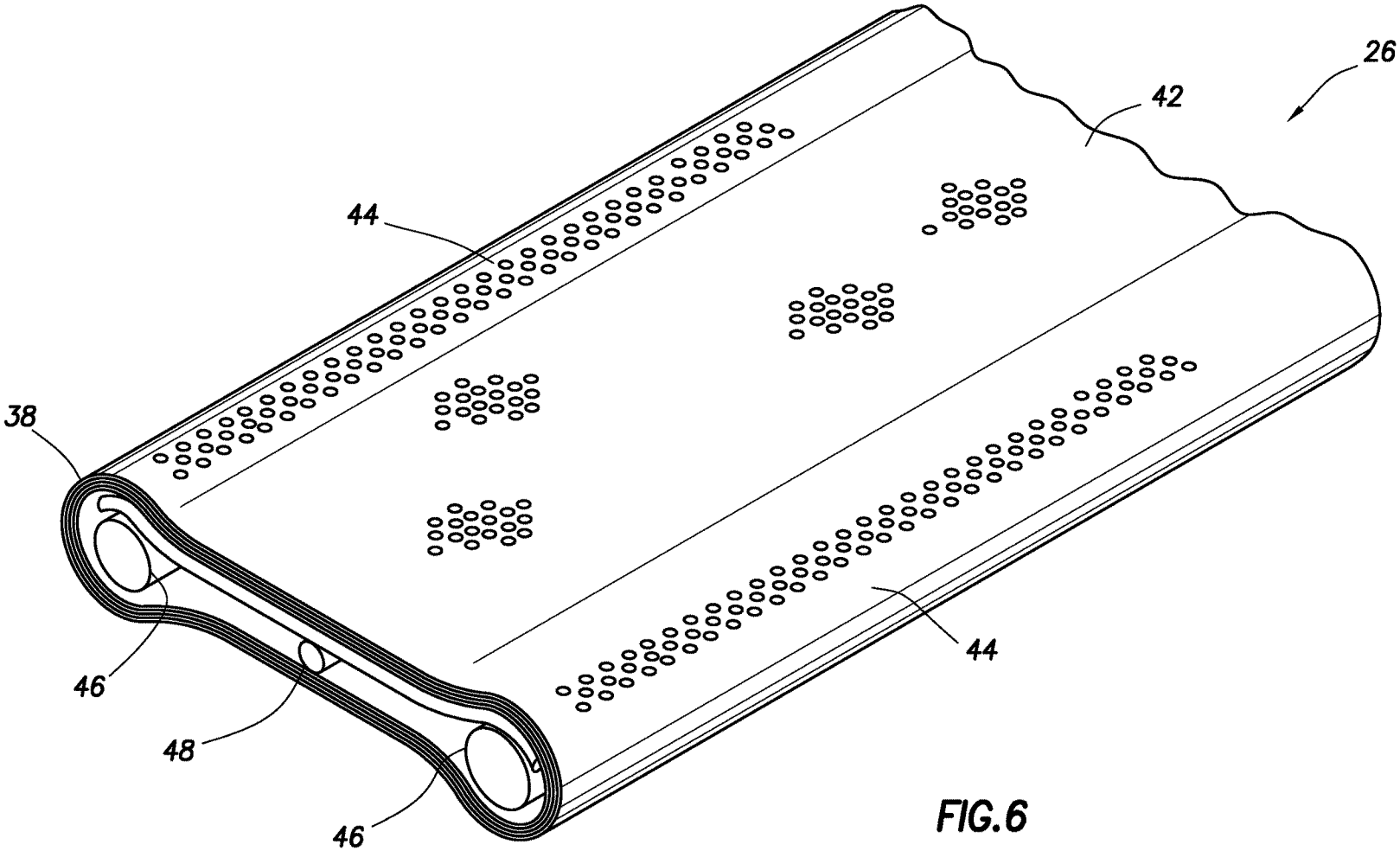
FIG. 6 is a representative perspective view of an improved filter section which can embody principles of this disclosure.

Referring additionally now to FIG. 6, a perspective view of one example of the filter section 26 is representatively illustrated. In this example, the filter section 26 has an outer surface 42 that is recessed relative to a raised boundary 44.

In the FIG. 6 example, raised boundaries 44 are depicted on either side of the recessed outer surface 42. However, it will be appreciated that a single raised boundary 44 could completely (or nearly completely) enclose the recessed outer surface 42. Separate boundaries 44 may be used, or multiple boundaries may be used.

The raised outer boundaries 44 depicted in FIG. 6 are internally supported by longitudinally extending ribs or other structures 46 within the wall 38 of the filter section 26. The structures 46 are enlarged (e.g., having larger diameters, in this example) as compared to other ribs or structures 48 underlying the recessed outer surface 42.

The structures 46, 48 may be maintained in their relative positions by multiple longitudinally spaced and generally circumferentially extending wires (only one of which is visible in FIG. 6) attached to each of the structures (e.g., by welding, brazing, sintering, etc.). The wires, along with the structures 46, 48 also function to maintain the space between the inner and outer sides of the filter section wall 38, thereby providing for flow of fluid in the interior of the filter section 26 and preventing the wall inner and outer sides from contacting each other when the filter section is biased outward.

Figure 7:
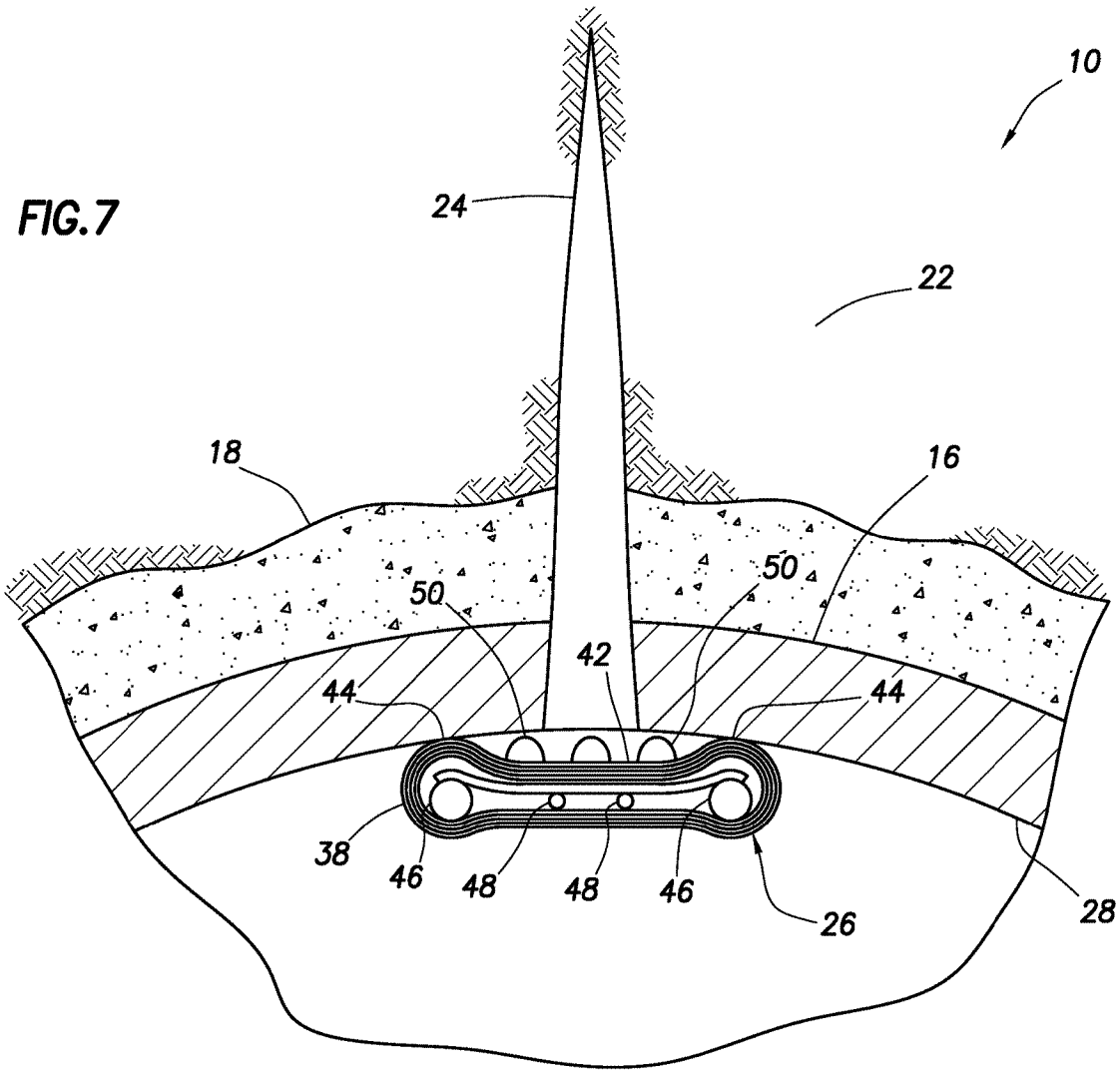
FIG. 7 is a representative cross-sectional view of the filter section of FIG. 6 displaced against the well surface.

Referring additionally now to FIG. 7, the filter section 26 of FIG. 6 is representatively illustrated as being in contact with the well surface 28. Note that the raised boundaries 44 maintain the recessed outer surface 42 spaced away from the surface 28, so that more of the area of the outer side of the wall 38 is available for flow.

In the FIG. 7 example, two of the structures 48 are shown, whereas in FIG. 6, only one of the structures is depicted. This demonstrates that a variety of different configurations, numbers, arrangements and types of internal structures 46, 48 may be used, in keeping with the scope of this disclosure.

The FIG. 7 example also includes several dimples or projections 50 on the recessed outer surface 42. The projections 50 help to maintain the outer surface 42 spaced apart from the well surface 28. Note that the projections 50 may be used without also using the raised boundaries 44.

Figure 8:
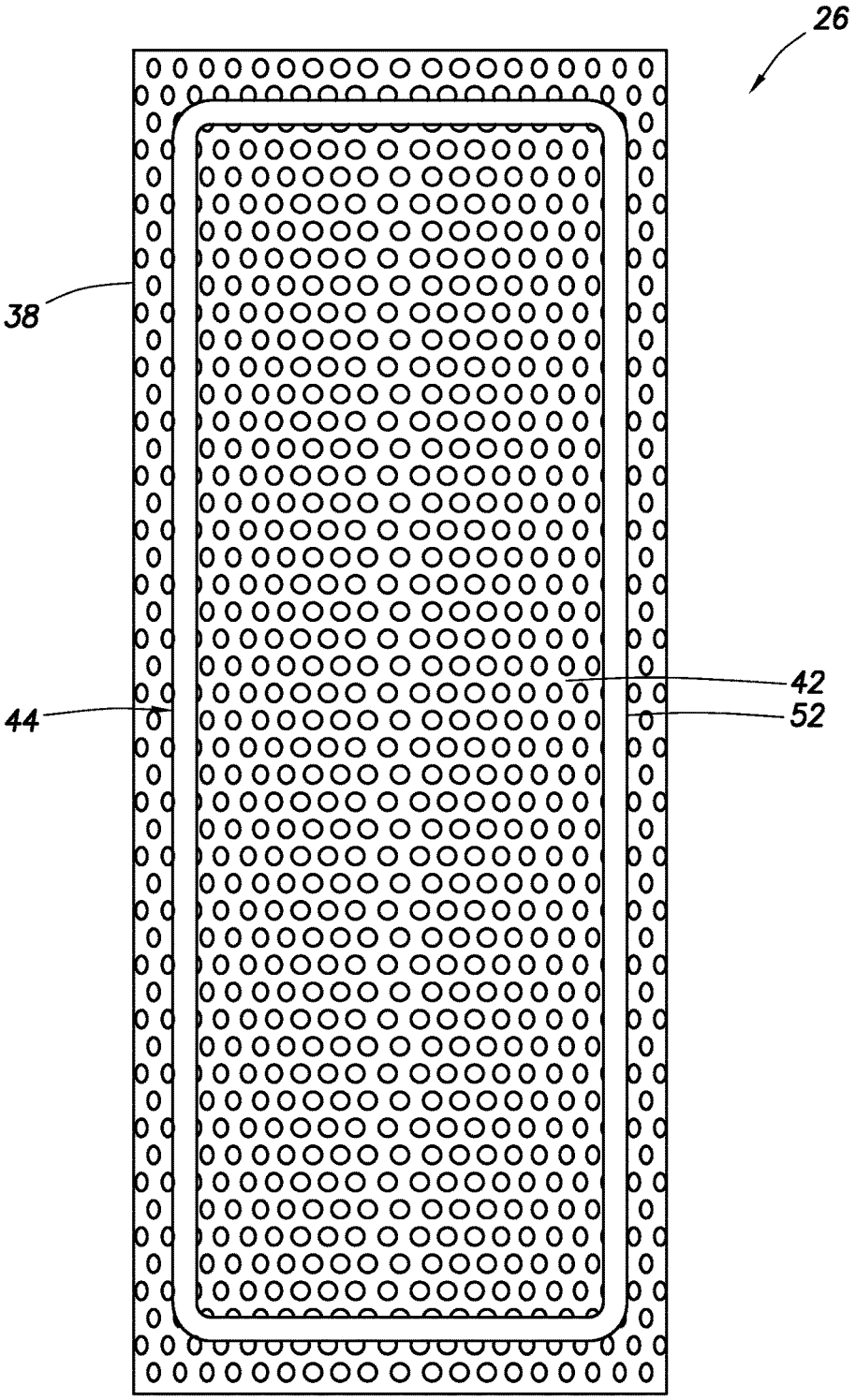
FIG. 8 is a representative side view of another example of the filter section.

Referring additionally now to FIG. 8 another example of the filter section 26 is representatively illustrated. In this example, the raised boundary 44 comprises a structure 52 attached on the outer side of the filter section wall 38.

As depicted in FIG. 8, the structure 52 is in the form of a generally rectangular shaped rod or wire attached to the exterior of the filter section 26, for example, by welding, brazing, sintering, etc. When attached to the filter section wall 38, the structure 52 forms the boundary 44, which completely encloses the recessed outer surface 42.

The boundaries 44 of FIGS. 6-8 not only space the recessed outer surface 42 away from the well surface 28, but they also form a barrier to prevent (or at least mitigate) extrusion of the swellable material 30 onto the recessed outer surface when the material swells. This helps to maintain the entire surface area of the recessed outer surface 42 available for flow therethrough. Note, however, that the boundaries 44 may be used whether or not the swellable material 30 is also used to outwardly displace the filter section 26.

Figure 9:
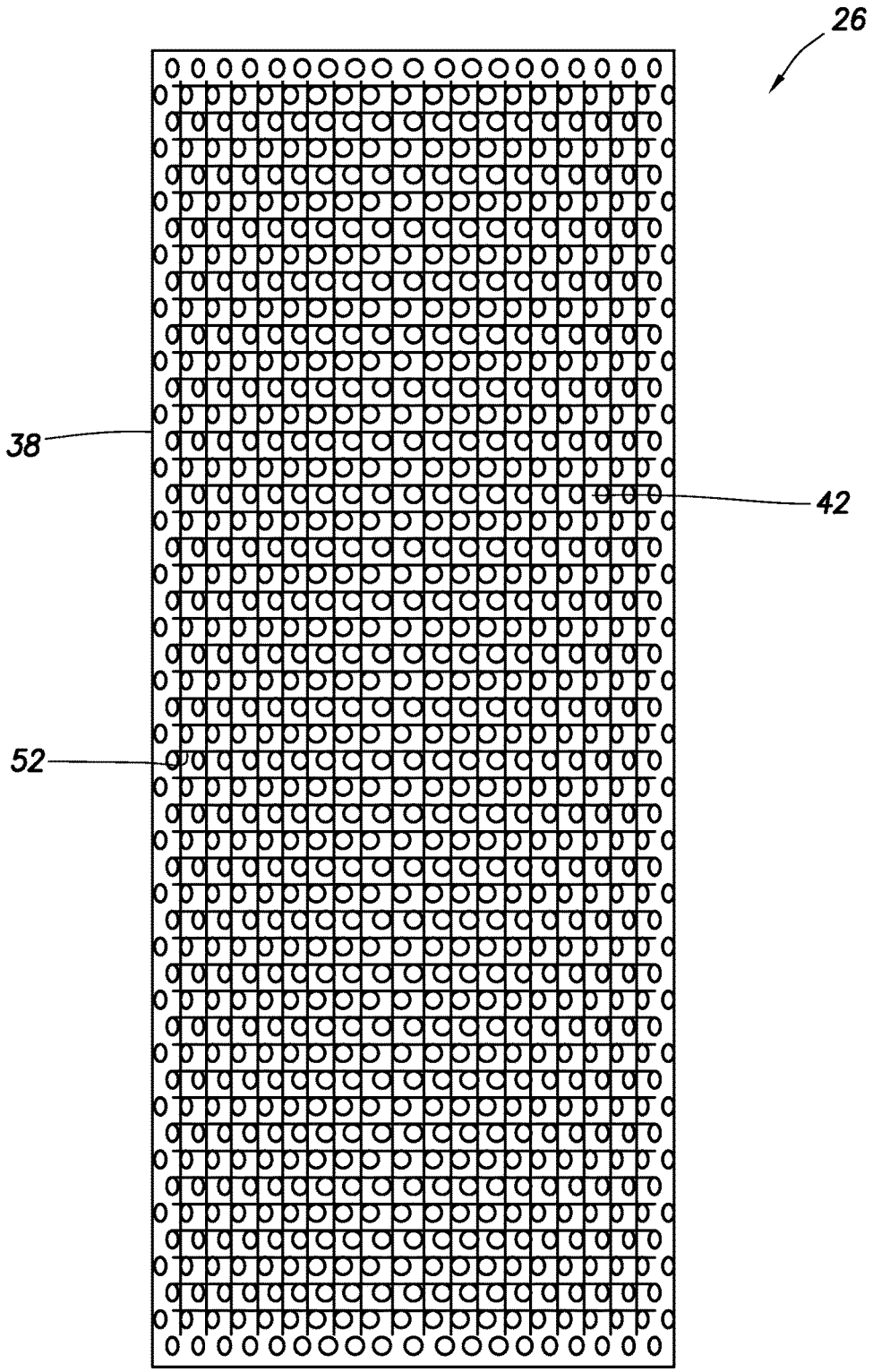
FIG. 9 is a representative side view of another example of the filter section.

Referring additionally now to FIG. 9, another example of the filter section 26 is representatively illustrated. In this example, the structure 52 is in the form of a relatively coarse woven wire material (such as a square weave) attached to the outer surface 42.

The structure 52 in this example functions to space the outer surface 42 away from the well surface 28 when the filter section 26 is displaced outward. In addition, the structure 52 can serve to mitigate extrusion of the swellable material 30 onto the outer surface 42 when the material swells.

Figure 10:
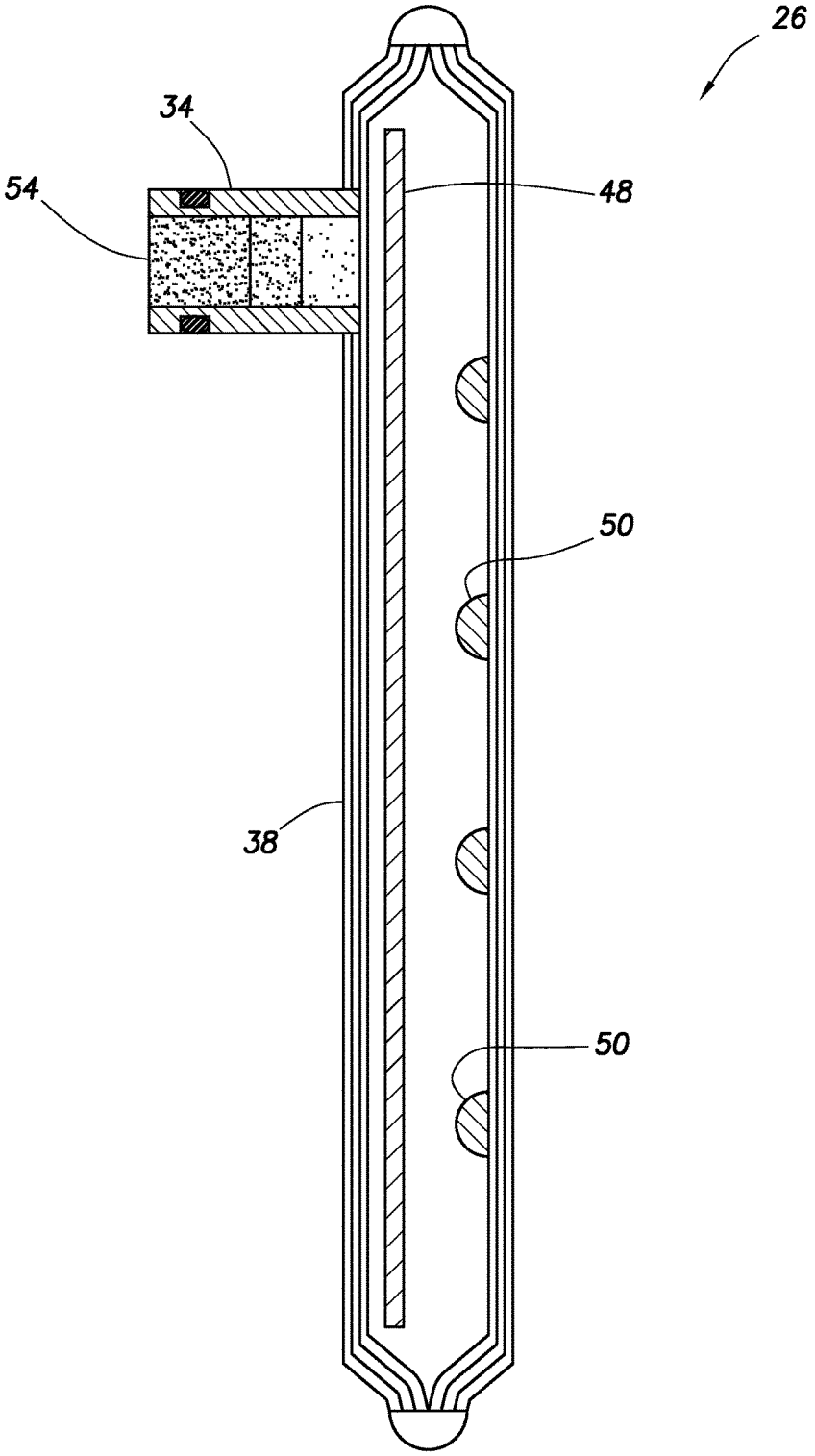
FIG. 10 is a representative cross-sectional view of another example of the filter section.

Referring additionally now to FIG. 10, another example of the filter section 26 is representatively illustrated in a longitudinal cross-sectional view. In this example, various structures (e.g., structures 48, 50) can be positioned in the interior of the filter section 26, in order to prevent the wall 38 inner and outer sides from contacting each other, thereby providing for relatively unrestricted flow of fluid 40 within the filter section.

The wall 38 in this example may be relatively rigid, that is, more rigid than the filter section walls of the FIGS. 6-9 examples (in which the wall serves to filter the fluid 40), since, in combination with the structures 48, 50, the wall in the FIG. 10 example serves as a drainage layer for a filter media 54 disposed, for example, in the tubular connector 34. Thus, the wall 38 and structures 48, 50 in the FIG. 10 example serve to conduct fluid to the filter media 54 and increase an area available for such flow. The wall 38 outer side can also serve to support the wall of the wellbore 14 if the wellbore is uncased.

The filter media 54 can comprise any number, type or configuration of filter media. For example, sintered metal, wire mesh and/or other types of filter media may be used.

Figure 11:
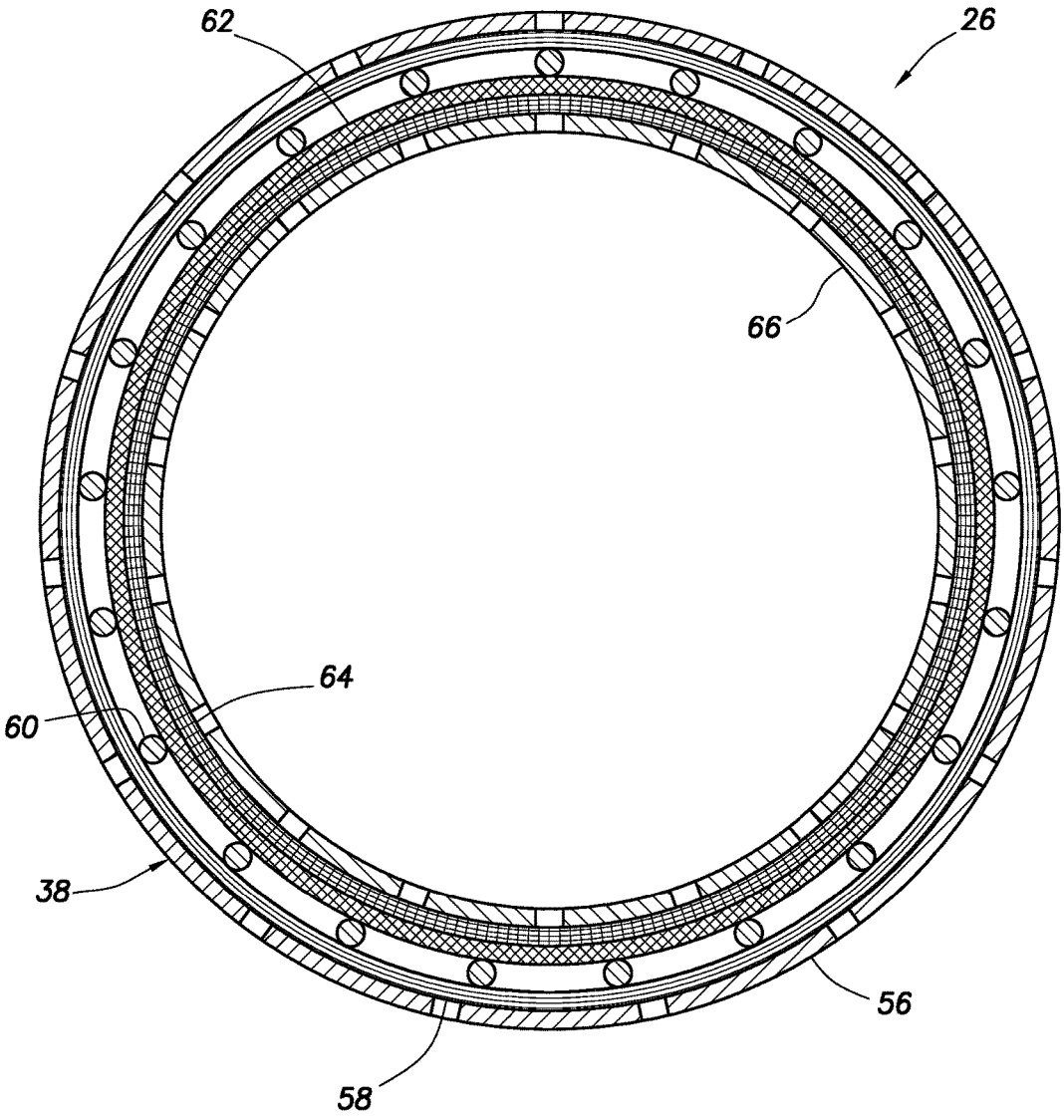
FIG. 11 is a representative cross-sectional view of another example of the filter section.

Referring additionally now to FIG. 11, another example of the filter section 26 is representatively illustrated in a cross-sectional view. The FIG. 11 view depicts the wall 38 in its circular configuration, prior to being formed into the partially circumferentially extending shape (e.g., as shown in FIGS. 6 & 7).

Note that the wall 38 is made up of multiple layers. In this example, the layers include an outer perforated shroud 56, circumferentially extending wire wraps 58, longitudinally extending ribs 60, relatively fine wire mesh 62, relatively coarse wire square weave 64, and an inner perforated shroud 66. More or less layers, and different combinations of layers, may be used in keeping with the scope of this disclosure.

The wire wraps 58 are preferably attached to the ribs 60, similar to a conventional wire-wrapped well screen. The wire wraps 58 and ribs 60 could be expanded into the outer shroud 56 as part of a manufacturing process.

The presence of the wire wraps 58 and ribs 60 within the outer shroud 56 provides a drainage layer, which allows fluid to flow over a substantial surface area of the wire mesh 62. Thus, even though the fluid 40 may enter the outer shroud at only a small area (e.g., an area underlying a perforation 24), the wire wraps 58 and ribs 60 allow the fluid to flow through a substantial area of the wire mesh 62.

The wire mesh 62 serves as a filter layer and, thus, is sized appropriately to exclude particles of minimum size that might be entrained with the fluid 40. The square weave 64 serves as another drainage layer on an interior of the filtering wire mesh 62, in order to provide for relatively unrestricted flow between the wire mesh layer and the inner shroud 66.

For incorporation into the well screen 20, the wall 38 of FIG. 11 is deformed by dies (or otherwise "smashed") into the partially circumferentially extending shape, so that the wall has inner and outer sides. One or more tubular connectors 34 are attached to the inner side of the wall 38. Longitudinal ends of the filter section 26 can be crimped together and welded to close them off.

It may now be fully appreciated that the above disclosure provides significant advancements to the art of constructing expandable well screens for use in subterranean wells. In examples described above, filter sections 26 of an expandable well screen 20 can be configured so that increased surface area is provided for flow of a fluid 40, and/or extrusion of a swellable material 30 onto an outer side of the filter sections can be prevented, or at least mitigated.

An expandable well screen 20 is described above. In one example, the well screen 20 can include a filter section 26 which is displaced outward when the well screen 20 is positioned downhole. The filter section 26 can include an outer surface 42 that is recessed relative to a raised boundary 44 of the filter section 26 adjacent the recessed outer surface 42.

The raised boundary 44 may completely or substantially surround the recessed outer surface 42. In some examples, the boundary 44 may not surround the outer surface 42.

The raised boundary 44 may comprise one or more first structures 46 enclosed within the filter section 26. The structures 46 may be enlarged relative to one or more second structures 48 underlying the recessed outer surface 42.

The raised boundary 44 may comprise a structure 52 attached externally to the filter section 26.

The expandable well screen 20 can include one or more projections 50 attached to the recessed outer surface 42.

The expandable well screen 20 may include a swellable material 30 which swells downhole in response to contact with a fluid, and thereby displaces the filter section 26 outward. The fluid which causes the material 30 to swell may be the fluid 40 described above, or another fluid.

Another expandable well screen 20 described above can include a filter section 26 which is displaced outward when the well screen 20 is positioned downhole, with the filter section 26 including an outer surface 42 having one more structures 52 thereon which space the outer surface 42 away from a well surface 28 when the filter section 26 is displaced outward.

The structures 52 may comprise projections 50, a wire mesh, and/or an elongated boundary (e.g., the structure 52 of FIG. 8) which at least partially bounds a portion of the outer surface 42.

The structures 52 can be on a portion of the outer surface 42 which is recessed relative to a raised boundary 44 of the filter section 26 adjacent the outer surface 42.

The expandable well screen 20 can include a swellable material 30 which swells downhole in response to contact with a fluid, and thereby displaces the filter section 26 outward. Any number of filter sections 26 may be used.

Another example of an expandable well screen 20 described above can include a filter section 26 which is displaced outward when the well screen 20 is positioned downhole, with the filter section 26 including one or more structures 48, 50 on an interior thereof which space apart inner and outer sides of a wall 38 of the filter section 26. A telescoping tubular connector 34 provides fluid communication between the filter section 26 and a base pipe 32 of the well screen 20, and a filter media 54 is positioned in the tubular connector 34.

The structures can comprise projections 50 on at least one side of the wall 38 of the filter section 26. The structures can comprise elongated ribs (such as structures 48).

The wall 38 of the filter section 26 may comprise a relatively rigid drainage layer of the filter section 26.

Another expandable well screen 20 can include a filter section 26 which is displaced outward when the well screen 20 is positioned downhole, with the filter section 26 including a partially circumferentially extending wall 38 having inner and outer sides. The wall 38 includes a circumferentially extending wire wrap 58 and longitudinally extending ribs 60 interposed between an outer shroud 56 and a filtering layer (such as wire mesh 62). The wire wrap 58, ribs 60, outer shroud 56 and filtering layer 62 are present in both of the inner and outer sides of the wall 38.

The filtering layer may comprise a wire mesh 62. The filtering layer can be interposed between the ribs 60 and a drainage layer. The drainage layer may comprise a square weave 64. The drainage layer may be interposed between the filtering layer 62 and an inner shroud 66.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An expandable well screen, comprising:

a plurality of circumferentially spaced apart filter sections, each filter section of which is displaced outward when the well screen is positioned downhole, each filter section comprising a flattened tubular screen defining an outer wall and an inner wall radially inward from the outer wall, the outer wall including an outer surface that is recessed relative to a raised boundary of the outer wall of the filter section adjacent the recessed outer surface.

2. The expandable well screen of claim 1, wherein the raised boundary completely surrounds the recessed outer surface.

3. The expandable well screen of claim 1, wherein the raised boundary substantially surrounds the recessed outer surface.

4. The expandable well screen of claim 1, wherein the raised boundary comprises one or more first structures enclosed within the filter section.

5. The expandable well screen of claim 4, wherein the first structures are enlarged relative to one or more second structures underlying the recessed outer surface.

6. The expandable well screen of claim 1, wherein the raised boundary comprises a structure attached externally to the filter section.

7. The expandable well screen of claim 1, further comprising one or more projections attached to the recessed outer surface.

8. The expandable well screen of claim 1, further comprising a swellable material which swells downhole in response to contact with a fluid, and thereby displaces the filter section outward.

9. An expandable well screen, comprising:

a plurality of circumferentially spaced apart filter sections, each filter section of which is displaced outward when the well screen is positioned downhole, each filter section comprising a flattened tubular screen defining an outer wall and an inner wall radially inward from the outer wall, the outer wall including an outer surface having one or more structures thereon which space the outer surface away from a well surface when the filter section is displaced outward, and wherein the structure comprises an elongated boundary which at least partially bounds a portion of the outer surface.

10. The expandable well screen of claim 9, wherein the structures comprise projections.

11. The expandable well screen of claim 9, wherein the structures comprise a wire mesh.

12. The expandable well screen of claim 9, wherein the structures are on a portion of the outer surface which is recessed relative to a raised boundary of the filter section adjacent the outer surface.

13. The expandable well screen of claim 9, further comprising a swellable material which swells downhole in response to contact with a fluid, and thereby displaces the filter section outward.

14. An expandable well screen, comprising:

a plurality of circumferentially spaced apart filter sections, each filter section of which is displaced outward when the well screen is positioned downhole, each filter section comprising a flattened tubular screen defining an outer wall and an inner wall radially inward from the outer wall, the outer wall including one or more structures on an interior thereof which space apart the inner an outer walls of the filter section and which define an elongated boundary in the outer wall that at least partially bounds a portion of an outer surface of the outer wall, a telescoping tubular connector which provides fluid communication between the filter section and a base pipe of the well screen, and a filter media being positioned in the tubular connector.

15. The expandable well screen of claim 14, wherein the structures further comprise projections on the outer side of the wall of the filter section.

16. The expandable well screen of claim 14, wherein the structures comprise elongated ribs.

17. The expandable well screen of claim 14, wherein the wall of the filter section comprises a relatively rigid drainage layer of the filter section.

18. The expandable well screen of claim 14, further comprising a swellable material which swells downhole in response to contact with a fluid, and thereby displaces the filter section outward.

19. An expandable well screen, comprising:

a plurality of circumferentially spaced apart filter sections, each filter section of which is displaced outward when the well screen is positioned downhole, each filter section comprising a flattened tubular screen defining an outer wall and an inner wall radially inward from the outer wall, the inner and outer walls extending partially circumferentially, the inner wall and outer wall including a circumferentially extending wire wrap and longitudinally extending ribs interposed between an outer shroud and a filtering layer, the wire wrap, ribs, outer shroud and filtering layer being present in both of the inner and outer walls; and the outer wall includes an outer surface that is recessed relative to a raised boundary of the outer wall of the filter section adjacent the recessed outer surface.

20. The expandable well screen of claim 19, wherein the filtering layer comprises a wire mesh.

21. The expandable well screen of claim 19, wherein the filtering layer is interposed between the ribs and a drainage layer.

22. The expandable well screen of claim 21, wherein the drainage layer comprises a square weave.

23. The expandable well screen of claim 21, wherein the drainage layer is interposed between the filtering layer and an inner shroud.

24. The expandable well screen of claim 19, further comprising a swellable material which swells downhole in response to contact with a fluid, and thereby displaces the filter section outward.

* * * * *